United States Patent [19]

Vanier

[11] Patent Number: 4,740,496

[45] Date of Patent: Apr. 26, 1988

[54] RELEASE AGENT FOR THERMAL DYE TRANSFER

[75] Inventor: Noel R. Vanier, Rochester, N.Y.

[73] Assignee: Eastman Kodak Company, Rochester, N.Y.

[21] Appl. No.: 934,290

[22] Filed: Nov. 24, 1986

Related U.S. Application Data

[63] Continuation-in-part of Ser. No. 813,165, Dec. 24, 1985, abandoned.

[51] Int. Cl.[4] ..... B41M 5/26

[52] U.S. Cl. ..... 503/227; 8/471; 427/256; 428/195; 428/422; 428/423; 428/447; 428/480; 428/484; 428/913; 428/914

[58] Field of Search ..... 8/470, 471; 346/227; 428/195, 211, 913, 914, 411.1, 422, 423, 447, 480, 484; 427/256; 430/945; 503/227

[56] References Cited

U.S. PATENT DOCUMENTS

| | | | |
|---|---|---|---|
| 4,256,459 | 3/1981 | Russell et al. | 8/471 |
| 4,572,860 | 2/1986 | Nakamura et al. | 8/471 |

FOREIGN PATENT DOCUMENTS

| | | | |
|---|---|---|---|
| 133012 | 5/1985 | European Pat. Off. | 503/227 |
| 19138 | 1/1985 | Japan | 503/227 |
| 0212394 | 10/1985 | Japan | 346/227 |

*Primary Examiner*—Bruce H. Hess
*Attorney, Agent, or Firm*—Harold E. Cole

[57] ABSTRACT

A dye-donor element for a thermal dye transfer assemblage comprises a support having thereon a dye layer and a release agent comprising:

a straight chain alkyl or polyethylene oxide perfluoroalkylated ester or perfluoroalkylated ether;

a perfluorinated alkyl-sulfonamidoalkyl acrylate copolymerized with a polyoxyethylene-4-thiaheptandioate ester;

a silicon polymer comprising units of a linear or branched alkyl or aryl siloxane;

carnauba wax;

bees wax;

polyethylene wax having a melting point of 115° C. or above;

an unmodified polyalkylene oxide;

stearic acid;

a fatty acid amide; or mixtures thereof. The release agent aids in separating the dye-donor element from the dye-receiving element after transfer.

19 Claims, No Drawings

RELEASE AGENT FOR THERMAL DYE TRANSFER

This application is a continuation-in-part of U.S. application Ser. No. 813,165, filed Dec. 24, 1985, now abandoned.

This invention relates to a dye-donor element for a thermal dye transfer assemblage, and more particularly to the use of a particular release agent to aid in separating the dye-donor element from the dye-receiving element after transfer.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yelllow signals. The process is then repeated for the other two colors. A color hard copy is thus obtained which corresponds to the original picture viewed on a screen. Further details of this process and an apparatus for carrying it out are contained in U.S. Ser. No. 778,960 by Brownstein entitled "Apparatus and Method For Controlling A Thermal Printer Apparatus," filed Sept. 23, 1985, the disclosure of which is hereby incorporated by reference.

A problem exists with many of the dye-donor and dye-receiving elements used in thermal dye transfer systems. At high temperatures used for thermal dye transfer, many polymers in these elements soften and adhere to each other, resulting in sticking and tearing of the elements upon separation. Areas of the dye-donor itself (other than the transferred dye) may adhere to the dye-receiving element, rendering it useless.

EP No. 133,012 and Japanese Patent Publication No. 85/19,138 relate to the use of certain release agents in the dye-receiving element of a thermal dye transfer assemblage in order to prevent the donor and receiving elements from sticking to each other after transfer. There is a problem, however, with using these materials in a dye-receiving element which is to be laminated, i.e., encased in a plastic pouch for protection. In that situation, the release agent frequently prevents the adhesive in the laminating pouch from sticking to the receiving element. The result is a laminated card with a delaminated central area.

It would be desirable to provide a dye-donor element and a thermal dye-transfer assemblage in which separation is facilitated after a thermal dye transfer printing operation has taken place, and which would provide adequate adhesion between the dye-receiving element and a subsequently-applied protective layer laminated thereto.

Thus, in accordance with this invention, a thermal dye transfer assemblage is provided which comprises:

(a) a dye-donor element comprising a support having thereon a dye layer, and (b) a dye-receiving element comprising a support having thereon a dye image-receiving layer, the dye-receiving element being in a superposed relationship with the dye-donor element so that the dye layer of the donor element is in contact with the dye image-receiving layer of the receiving element, and wherein the dye layer contains a release agent comprising:

a straight chain alkyl or polyethylene oxide perfluoroalkylated ester or perfluoroalkylated ether;

a perfluorinated alkyl-sulfonamidoalkyl acrylate copolymerized with a polyoxyethylene-4-thiaheptandioate ester;

a silicone polymer comprising units of a linear or branched alkyl or aryl siloxane;

carnauba wax;

bees wax;

polyethylene wax having a melting point of 115° C. or above;

an unmodified polyalkylene oxide, such as polyethylene oxide, polypropylene oxide or polybutylene oxide;

stearic acid;

a fatty acid amide, such as erucamide, erucylerucamide, stearamide, oleamide, behenamide or arachidiamide; or mixtures thereof. Use of the release agent aids in separating the dye-donor element from the dye-receiving element after transfer and will not interfere with adhering the dye-receiving element, after dye-transfer printing, to a protective polymeric layer.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

In a preferred embodiment of the invention, the straight chain alkyl or polyethylene oxide perfluoroalkylated ester or perfluoroalkylated ether release agent has the following formula:

$$C_nF_{2n+1}SO_2-\overset{\overset{R^1}{|}}{N}-CH_2R^2$$

wherein $R^1$ is an alkyl or substituted alkyl group having from 1 to about 6 carbon atoms such as methyl, ethyl, butyl, isopropyl, 2-hydroxyethyl, or 2-ethoxyethyl; or an aryl or substituted aryl group having from about 6 to about 10 carbon atoms such as phenyl, p-tolyl or p-methoxyphenyl;

$R^2$ is $$-CO\text{-}\{OCH(CH_3)CH_2OCH_2CH_2\}_wR^3,\ -COO\text{-}(CH_2-CH_2-O)_xR^3,\ -COO\text{-}(CH_2)_yR^3 \text{ or } -CH_2-O\text{-}(CH_2-CH_2-O)_zR^3;$$

$R^3$ is H or $R^1$;

n is an integer of from about 4 to about 20; and w, x, y and z each independently represents an integer of from about 2 to about 50.

In another preferred embodiment, $R^1$ in the above formula is methyl or ethyl, n is 8 and $R^3$ is H.

In another preferred embodiment of the invention, the silicon polymer release agent is a copolymer of a polyalkylene oxide and a methyl alkylsiloxane, such as BYK-320® or BYK-301® (BYK Chemie, USA). Other suitable silicone materials include linear or pendant polyoxyalkylene-group block copolymers.

The release agent used in the invention may be employed in any amount which is effective for the intended purpose, i.e., substantially clean separation of the receiving element and the donor element with substantially none of the donor element (other than dye) adhering to the receiving element. In general, good results have been obtained at a concentration of from about 0.25 to about 7.5%, based on the total coating weight of binder of the dye-donor element. The particular amount to be employed will vary, of course, depending on the particular release agent employed and the particular polymers in the assemblage selected.

Specific release agents useful in the invention include the following:

$$C_8F_{17}SO_2\overset{\overset{C_2H_5}{|}}{N}-CH_2-\overset{\overset{O}{\|}}{C}-O\left(CH_2-CH_2-O\right)_{40}-H. \quad (1)$$

This material is supplied commercially as Fluorad ®FC-431 (3M Company).

$$C_8F_{17}SO_2\overset{\overset{C_2H_5}{|}}{N}-CH_2-\overset{\overset{O}{\|}}{C}-O\left(CH_2\right)_{40}-H. \quad (2)$$

This material is supplied commercially as Fluorad ®FC-432 (3M Company).

$$C_8F_{17}SO_2\overset{\overset{C_2H_5}{|}}{N}\left(CH_2-CH_2-O\right)_{2-30}H. \quad (3)$$

This material is supplied commercially as Fluorad ®FC-170 (3M Company).

(4) A perfluorinated alkyl-sulfonamidoalkyl ester of a polyethylene-propylene glycol $$C_8F_{17}SO_2N(CH_3)CH_2CO[OCH(CH_3)CH_2OCH_2CH_2]_{10-20}OH.$$

This material is supplied commercially as Fluorad ®FC-430 (3M Company).

(5) A perfluorinated alkyl-sulfonamidoalkyl acrylate copolymerized with a polyoxyethylene-4-thiaheptandioate ester $$\left(\underset{\underset{CO_2CH_2CH_2N(CH_3)SO_2C_8F_{17}}{|}}{CH}-CH_2\right)_x\left(CH_2CH_2CO_2(CH_2CH_2O)_nOCCH_2CH_2S\right)_y,$$

wherein x is 5–20%, y is 95–80% and n is 2–10. This material is supplied commercially as L2277® (3M Company).

(6) A solution of a polyoxyalkylene-dimethyl siloxane copolymer $$\left(Si(CH_3)_2O\right)_x\left(\left(CH_2\underset{\underset{R}{|}}{CHO}\right)_n\right)_y,$$

wherein R is H or lower alkyl, n is 2–20, x is 20–100 and y is 20–100. This material is supplied commercially as BYK-301® (BYK Chemie USA), molecular weight approximately 2,000–20,000.

(7) Carnauba wax. This material is described in the literature as mainly myricyl cerotate:

$$C_{26}H_{53}CO_2C_{30}H_{61}.$$

(8) Bees wax. This material is described in the literature as containing cerolein, cerotic acid, myricyl alcohol, melissic acid, and alkanes.

(9) S395 N5® polyethylene wax having a melting point of 125° C. This material is supplied commercially by Shamrock Chemicals Co. and described as having a high molecular weight and an average particle size of app. 12.5 mμ.

(10) Carbowax 6000® polyethylene oxide of nominal average 6000 molecular weight (Union Carbide Co.).

(11) Stearic acid—$C_{17}H_{35}CO_2H$.

(12) Erucamide—$C_{21}H_{41}CONH_2$ such as Kemamide E® (Humko-Sheffield Co.).

(13) Erucylerucamide—$C_8F_{17}CH{=}CHC_{11}H_{22}CONHC_{12}H_{24}CH{=}CHC_8H_{17}$ such as Kemamide E221® (Humko-Sheffield Co.)

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

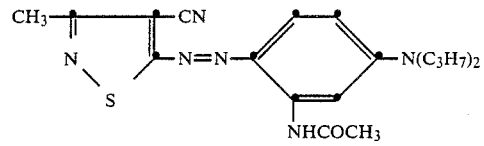

(magenta)

-continued

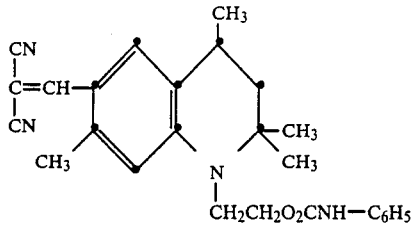

(yellow)

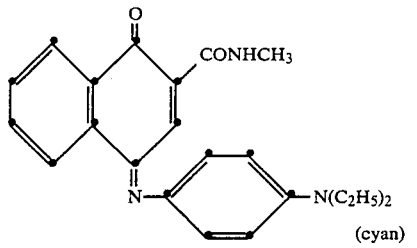

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element of the invention is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye laser of the dye-donor element may be coated on the support or printed thereon by a printing technique such as a gravure process.

Any material can be used as the support for the dye-donor element employed in the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-cohexafluoropropylene); polyethers such as polyoxymethylene; polyacetals; polyolefins such as polystyrene, polyethylene, polypropylene or methylpentane polymers; and polyimides such as polyimide-amides and polyether-imides. The support generally has a thickness of from about 2 to about 30 $\mu$m. It may also be coated with a subbing layer, if desired.

A dye-barrier layer comprising a hydrophilic polymer may also be employed in the dye-donor element of the invention between its support and the dye layer which provides improved dye transfer densities.

The reverse side of the dye-donor element of the invention may be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate or ethyl cellulose.

The amount of the lubricating material to be used in the slipping layer depends largely on the type of lubricating material, but is generally in the range of about 0.001 to about 2 g/m$^2$. If a polymeric binder is employed, the lubricating material is present in the range of 0.1 to 50 weight %, preferably 0.5 to 40, of the polymeric binder employed.

The dye-receiving element that is used with the dye-donor element of the assemblage of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements employed in the invention are used to form a dye transfer image. Such a process comprises imagewise-heating a dye-donor element as described above and transferring a dye image to a dye-receiving element as described above to form the dye transfer image.

The dye-donor element employed in the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

The following examples are provided to illustrate the invention.

EXAMPLE 1

A cyan dye-donor element was prepared by coating the following layers in the order recited on a 6 μm poly(ethylene terephthalate) support:

(1) Dye-barrier layer of gelatin nitrate (gelatin, cellulose nitrate and salicylic acid in approximately 20:5:2 weight ratio in a solvent of acetone, methanol and water) (0.054 g/m$^2$), and (2) Dye layer containing the cyan dye described above (0.26 g/m$^2$) in a binder of cellulose acetate propionate (2.5% acetyl and 45% propionyl) (0.39 g/m$^2$) and containing the release agent indicated in Table 1 coated from a cyclopentanone and 2-butanone solvent mixture.

On the back side of the element was coated a slipping layer of the type disclosed in U.S. application Ser. No. 813,199 of Vanier et al, filed Dec. 24, 1985.

A dye-receiving element was prepared by coating 2.9 g/m$^2$ of Makrolon 5705 ® (Bayer AG) polycarbonate resin from a methylene chloride and trichloroethylene solvent mixture on top of an ICI Melinex 990 ® white polyester support.

The dye side of the dye-donor element strip 1 inch (25 mm) wide was placed in contact with the dye image-receiving layer of the dye-receiver element of the same width. The assemblage was fastened in the jaws of a stepper motor driven pulling device. The assemblage was laid on top of a 0.55 (14 mm) diameter rubber roller and a Fujitsu Thermal Head and was pressed with a spring at a force of 3.5 pounds (1.6 kg) against the dye-donor element side of the assemblage pushing it against the rubber roller.

The imaging electronics were activated causing the pulling device to draw the assemblage between the printing head and roller at 0.123 inches/sec (3.1 mm/sec). Coincidentally, the resistive elements in the thermal print head were heated at 0.5 msec increments from 0 to 4.5 msec to generate a graduated density test pattern. The voltage supplied to the print head was approximately 19 v representing approximately 1.75 watts/dot. Estimated head temperature was 250°–400° C.

The effectiveness of separation of the dye-donor from the dye-receiver was evaluated by manual separation. The following results illustrate the use of the release agents of the invention in comparison to closely-related control release agents:

TABLE 1

| Amount of Release Agent in Donor Element (g/m$^2$) | | Sticking of Donor Element to Receiving Element Upon Manual Separation |
|---|---|---|
| Compound 1 | (0.022) | none |
| " | (0.044) | " |
| " | (0.088) | " |
| Compound 4 | (0.022) | none |
| " | (0.044) | " |
| " | (0.088) | " |
| Compound 5 | (0.022) | none |
| " | (0.044) | " |
| " | (0.088) | " |
| Compound 6 | (0.022) | none |
| " | (0.044) | " |
| " | (0.088) | " |
| Compound 7 | (0.022) | none |
| Compound 8 | (0.022) | none |
| Compound 9 | (0.022) | none |
| Compound 10 | (0.022) | none |
| Compound 11 | (0.022) | none |
| Compound 12 | (0.022) | none |
| Compound 13 | (0.022) | none |

TABLE 1-continued

| Amount of Release Agent in Donor Element (g/m$^2$) | | Sticking of Donor Element to Receiving Element Upon Manual Separation |
|---|---|---|
| Control 4 | (0.022) | partial |
| Control 1 | (0.022) | extensive |
| " | (0.044) | " |
| " | (0.088) | " |
| Control 2 | (0.022) | extensive |
| " | (0.044) | " |
| " | (0.088) | " |
| Control 3 | (0.022) | extensive |
| " | (0.044) | " |
| " | (0.088) | " |
| Control 5 | (0.022) | extensive |
| None: | None of the donor element or only a trace portion stuck to or was retained on the receiving element after they were easily pulled apart. | |
| Partial: | Small or minor portions of the donor element remaining on the receiving element after separation. | |
| Extensive: | Donor element and receiving element were difficult to peel apart and/or substantial portions of the donor element remained stuck to the receiving element. | |

Control Materials:
Control 1 - SF-96 ® dimethylpolysiloxane silicone fluid (General Electric Corp.)
Control 2 - Cab-O-Sil TS-720 ®, a hydrophobic amorphous fumed silica (Hercules Chemical Co.)
Control 3 - DLX-6000 ® poly(tetrafluoroethylene) micropowder (duPont Corp.)
Control 4 - Zonyl FSN ® polyethyleneglycol terminated with a perfluoroheptyl unit (duPont Corp.)
Control 5 - S394 N1 ® polyethylene wax (Shamrock Chemicals Co.), a medium molecular weight polyolefin having an average particle size of 5 μm and a melting point of 113° C.

The results indicate that the compounds of the invention were found to significantly improve separation, whereas the control materials did not.

EXAMPLE 2

A magenta dye-donor element was prepared by coating the following layers in the order recited on a 6 μm poly(ethylene terephthalate) support:

(1) Dye-barrier layer of gelatin nitrate (gelatin, cellulose nitrate and salicylic acid in approximately 20:5:2 weight ratio in a solvent of acetone, methanol and water) (0.17 g/m$^2$), and (2) Dye layer containing the following magenta dye (0.22 g/m$^2$) in a binder of polyvinyl alcohol-butyral (Butvar-76 ® Monsanto Corp.) (0.39 g/m$^2$) and containing the quantity of 3M Fluorad FC-431 ® release agent indicated in Table 2 coated from a cyclohexanone and 2-butanone solvent mixture

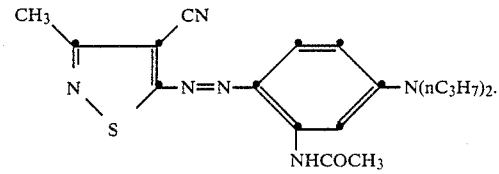

On the back side of the element, a slipping layer of poly(vinyl stearate) (0.30 g/m$^2$) in polyvinyl alcohol-butyral (0.45 g/m$^2$) was coated from tetrahydrofuran solvent.

A dye-receiving element was prepared as in Example 1.

The dye-donor and dye-receiving elements were processed as in Example 1.

The effectiveness of separation of the dye-donor from the dye-receiver was evaluated first by manual separation and second by using a "Scotch Tape Test" to remove any residual donor that might have stuck to the face of the receiver after manual separation. It was more difficult to obtain good separation at areas where more dye had transferred.

For the "Scotch Tape Test", approximately ½"×2" of 3M Type 810 ® Magic Transparent Tape was affixed to the face of the image area of the dye-receiver. D-min areas are represented by step 1 of the graduated density test pattern, approaching D-max at step 9. Thus, sticking at steps 2–9 indicates adhesion throughout the density pattern and is very undesirable. Sticking from 7–9 indicates less of a sticking problem (only at high density steps) and far more desirable.

The following results were obtained:

TABLE 2

| Amount of FC-431 ® in Donor* | Manual Separation - Sticking of Steps |
|---|---|
| 0% | 2–9 |
| 0.05% | 3–9 |
| 0.3% | 3–9 |
| 3% | 5–9 |
| 5% | 5–9 |

*based on amount of polycarbonate resin in receiver

TABLE 3

| Amount of FC-431 ® in Donor* | Residual Steps Unable To Be Removed By Scotch Tape Test |
|---|---|
| 0% | 6–9 |
| 0.05% | 6–9 |
| 0.3% | 7–9 |
| 3% | none |
| 5% | none |

*based on amount of polycarbonate resin in receiver

The above data show that sticking was minimized as the level of FC-431 ® was progressively increased. Also, even where various steps showed sticking in manual separation, the use of progressively increasing amounts of FC-431 ® enabled them to be removed by the Scotch Tape Test, indicating the useful effects of this release agent.

The invention has been described in detail with particular reference to preferred embodiments thereof, but it will be understood that variations and modifications can be effected within the spirit and scope of the invention.

What is claimed is:

1. In a thermal dye transfer assemblage comprising:

(a) a dye-donor element comprising a support having thereon a dye layer comprising a dye dispersed in a polymeric binder, and (b) a dye-receiving element comprising a support having thereon a polymeric dye image-receiving layer, said dye-receiving element being in a superposed relationship with said dye-donor element so that said dye layer is in contact with said dye image-receiving layer, the improvement wherein said dye layer contains a release agent in a concentration of from about 0.25 to about 7.5%, based on the total coating weight of polymer of said dye-image receiving layer or binder of said dye-donor element, said release agent being a straight chain alkyl or polyethylene oxide perfluoroalkylated ester or perfluoroalkylated ether;

a perfluorinated alkyl-sulfonamidoalkyl acrylate copolymerized with a polyoxyethylene-4-thiaheptandioate ester;

a silicone polymer comprising units of a linear or branched alkyl or aryl siloxane;

carnauba wax;

bees wax;

polyethylene wax having a melting point of 115° C. or above;

an unmodified polyalkylene oxide;

stearic acid;

a fatty acid amide; or mixtures thereof.

2. The assemblage of claim 1 wherein said release agent has the following formula:

$$C_nF_{2n+1}SO_2-\overset{\overset{R^1}{|}}{N}-CH_2R^2$$

wherein $R^1$ is an alkyl or substituted alkyl group having from 1 to about 6 carbon atoms or an aryl or substituted aryl group having from about 6 to about 10 carbon atoms;

$R^2$ is $$-CO\text{-}(OCH(CH_3)CH_2OCH_2CH_2)_wR^3,\ -COO\text{-}(CH_2-CH_2-O)_xR^3,\ -COO\text{-}(CH_2)_yR^3 \text{ or } -CH_2-O\text{-}(CH_2-CH_2-O)_zR^3;$$

$R^3$ is H or $R^1$;

n is an integer of from about 4 to about 20; and w, x, y and z each independently represents an integer of from about 2 to about 50.

3. The assemblage of claim 2 wherein $R^1$ is methyl or ethyl, n is 8 and $R^3$ is H.

4. The assemblage of claim 1 wherein said release agent is a copolymer of a polyalkylene oxide and a methyl alkylsiloxane.

5. The assemblage of claim 1 wherein said release agent is an unmodified polyethylene oxide, polypropylene oxide or polybutylene oxide.

6. The assemblage of claim 1 wherein said release agent is a fatty acid amide comprising erucamide, erucylerucamide, stearamide, oleamide, behenamide or arachidiamide.

7. The assemblage of claim 1 wherein the side of the support of the dye donor element, opposite the side having thereon said dye layer, is coated with a slipping layer comprising a lubricating material.

8. The assemblage of claim 1 wherein said support of the dye-donor element comprises poly(ethylene terephthalate).

9. The assemblage of claim 1 wherein said dye layer comprises sequential repeating areas of cyan, magenta and yellow dye.

10. In a process of forming a dye transfer image comprising imagewise-heating a dye-donor element comprising a support having thereon a dye layer comprising a dye dispersed in a polymer binder and transferring a dye image to a dye-receiving element comprising a support having thereon a polymeric dye image-receiving layer to form said dye transfer image, the improvement wherein said dye layer contains a release agent in a concentration of from about 0.25 to about 7.5%, based on the total coating weight of polymer of said dye-image receiving layer or binder of said dye-donor element, said release agent being

- a straight chain alkyl or polyethylene oxide perfluoroalkylated ester or perfluoroalkylated ether;
- a perfluorinated alkyl-sulfonamidoalkyl acrylate copolymerized with a polyoxyethylene-4-thiaheptandioate ester;
- a silicone polymer comprising units of a linear or branched alkyl or aryl siloxane;
- carnauba wax;
- bees wax;
- polyethylene wax having a melting point of 115° C. or above;
- an unmodified polyalkylene oxide;
- stearic acid;
- a fatty acid amide; or mixtures thereof.

11. The process of claim 10 wherein said release agent has the following formula:

$$C_nF_{2n+1}SO_2-\overset{\overset{\displaystyle R^1}{|}}{N}-CH_2R^2$$

wherein $R^1$ is an alkyl or substituted alkyl group having from 1 to about 6 carbon atoms or an aryl or substituted aryl group having from about 6 to about 10 carbon atoms;

$R^2$ is $$-CO\text{-}[OCH(CH_3)CH_2OCH_2CH_2]_wR^3,\ -COO\text{-}(CH_2-CH_2-O)_xR^3,\ -COO\text{-}(CH_2)_yR^3 \text{ or } -CH_2-O\text{-}(CH_2-CH_2-O)_zR^3;$$

$R^3$ is H or $R^1$;

n is an integer of from about 4 to about 20; and w, x, y and z each independently represents an integer of from about 2 to about 50.

12. The process of claim 11 wherein $R^1$ is methyl or ethyl, n is 8 and $R^3$ is H.

13. The process of claim 10 wherein said support of said dye-donor element is poly(ethylene terephthalate) which is coated with sequential repeating areas of cyan, magenta and yellow dye, and said process steps are sequentially performed for each color to obtain a three-color dye transfer image.

14. In a dye-donor element for thermal dye transfer comprising a support having thereon a dye layer comprising a dye dispersed in a polymeric binder, the improvement wherein said dye layer contains a release agent in a concentration of from about 0.25 to about 7.5%, based on the total coating weight of polymer of said binder of said dye-donor element, said release agent being

- a straight chain alkyl or polyethylene oxide perfluoroalkylated ester or perfluoroalkylated ether;
- a perfluorinated alkyl-sulfonamidoalkyl acrylate copolymerized with a polyoxyethylene-4-thiaheptandioate ester;
- a silicone polymer comprising units of a linear or branched alkyl or aryl siloxane;
- carnauba wax;
- bees wax;
- polyethylene wax having a melting point of 115° C. or above;
- an unmodified polyalkylene oxide;
- stearic acid;
- a fatty acid amide; or mixtures thereof.

15. The element of claim 14 wherein said release agent has the following formula:

$$C_nF_{2n+1}SO_2-\overset{\overset{\displaystyle R^1}{|}}{N}-CH_2R^2$$

wherein $R^1$ is an alkyl or substituted alkyl group having from 1 to about 6 carbon atoms or an aryl or substituted aryl group having from about 6 to about 10 carbon atoms;

$R^2$ is $$-CO\text{-}[OCH(CH_3)CH_2OCH_2CH_2]_wR^3,\ -COO\text{-}(CH_2-CH_2-O)_xR^3,\ -COO\text{-}(CH_2)_yR^3 \text{ or } -CH_2-O\text{-}(CH_2-CH_2-O)_zR^3;$$

$R^3$ is H or $R^1$;

n is an integer of from about 4 to about 20; and w, x, y and z each independently represents an integer of from about 2 to about 50.

16. The element of claim 15 wherein $R^1$ is methyl or ethyl, n is 8 and $R^3$ is H.

17. The element of claim 14 wherein said release agent is a copolymer of a polyalkylene oxide and a methyl alkylsiloxane.

18. The element of claim 14 wherein said release agent is an unmodified polyethylene oxide, polypropylene oxide or polybutylene oxide.

19. The element of claim 14 wherein said release agent is a fatty acid amide comprising erucamide, erucylerucamide, stearamide, oleamide, behenamide or arachidiamide.

* * * * *